United States Patent [19]

Chau

[11] Patent Number: 4,864,293

[45] Date of Patent: Sep. 5, 1989

[54] INGROUND BORING TECHNIQUE INCLUDING REAL TIME TRANSDUCER

[75] Inventor: Albert W. Chau, Redmond, Wash.

[73] Assignee: FlowMole Corporation, Kent, Wash.

[21] Appl. No.: 188,958

[22] Filed: Apr. 29, 1988

[51] Int. Cl.[4] ..... G01V 3/02

[52] U.S. Cl. ..... 340/856; 340/853; 166/65.1; 324/369

[58] Field of Search ..... 367/81, 82; 340/853, 340/856, 857; 166/65 R, 65.1, 66, 67; 175/45, 48; 73/151.5, 152; 324/324, 333, 363, 364, 366, 369, 370, 373, 374, 375

[56] References Cited

U.S. PATENT DOCUMENTS

| | | | |
|---|---|---|---|
| 2,354,887 | 8/1944 | Silverman et al. | 340/856 |
| 2,575,173 | 11/1951 | Johnson | 340/854 |
| 3,079,549 | 2/1963 | Martin | 340/853 |
| 3,713,089 | 1/1973 | Claycomb | 340/18 LD |
| 3,732,728 | 5/1973 | Fitzpatrick | 73/151 |
| 3,793,632 | 2/1974 | Still | 340/18 NC |
| 3,828,867 | 8/1974 | Elwood | 175/45 |
| 3,870,111 | 3/1975 | Tuomola et al. | 175/11 |
| 3,891,038 | 6/1975 | Delestrade et al. | 73/151.5 |
| 3,967,201 | 6/1976 | Borden | 325/28 |
| 4,057,781 | 11/1977 | Scherbatskoy | 340/18 LD |
| 4,087,781 | 5/1978 | Grossi et al. | 340/18 NC |
| 4,181,014 | 1/1980 | Zuvela | 73/151 |
| 4,302,757 | 11/1981 | Still | 340/854 |
| 4,348,672 | 9/1982 | Giver | 340/854 |
| 4,445,578 | 1/1984 | Millheim | 175/45 |
| 4,525,715 | 6/1985 | Smith | 340/854 |
| 4,562,559 | 12/1985 | Sharp et al. | 367/82 |
| 4,578,675 | 3/1986 | Macleod | 340/855 |
| 4,584,675 | 4/1986 | Peppers | 367/81 |
| 4,616,702 | 10/1986 | Hanson et al. | 340/856 X |
| 4,684,946 | 8/1987 | Issenmann | 340/855 |
| 4,724,434 | 2/1988 | Hanson et al. | 340/857 |

*Primary Examiner*—Brian S. Steinberger

*Attorney, Agent, or Firm*—Flehr, Hohbach, Test, Albritton & Herbert

[57] ABSTRACT

A system in which a boring tool is urged through the ground by means of a drill string in order to form an underground hole is disclosed herein along with an arrangement for obtaining certain information at the boring tool during operation of the boring tool. That arrangement includes a transducer carried by the boring tool for generating an AC signal containing desired information and means for connecting the transducer directly to the drill string and to the surrounding ground for transmitting the information containing signal to an above ground location.

12 Claims, 3 Drawing Sheets

INGROUND BORING TECHNIQUE INCLUDING REAL TIME TRANSDUCER

The present invention relates generally to boring apparatus and more particularly to an arrangement for collecting inground bore hole data and for transmitting the data to an above ground location in real time.

The concept of providing real time transmission of information taken at a boring tool as the tool is used to drill a hole in the ground is well known in the art. This concept is frequently referred to as Downhole Measuring While Drilling or simply Measuring While Drilling (MWD). An excellent discussion of this concept and a number of different approaches appear in the U.S. Pat. No. 4,348,672.

Two principal functions to be performed by a continuous MWD system are downhole measurements and data transmission. As will be seen hereinafter, the present invention is directed specifically to the transmission of data rather than the actual means for gathering it. In the case where this gathering means is a transducer which generates an AC signal containing the desired data, one way to transmit the signal to ground level from the boring device where the signal is generated is to use the cooperating drill string as the conductor, assuming of course that the drill string body defines a continuous electrically conductive path to ground level. A typical way in which the AC signal is first coupled to the drill string from the boring device and the way that it is typically decoupled from the drill string at ground level is by means of inductive coupling utilizing, for example, a toroidal transformer. While this technique presents no serious problems at ground level where there is sufficient room, applicant has found that a toroidal transformer or other such inductive means is quite difficult to use within the confines of the hole being drilled.

In view of the foregoing, it is an object of the present invention to provide a signal transmitting technique of the general type described immediately above, but one which does not inductively couple its AC signal to its cooperating drill string within its inground hole but rather provides a much less complicated and just as reliable coupling technique.

As will be described in more detail hereinafter, a boring apparatus including a boring tool and a drill string is disclosed herein. The boring tool is designed to bore a hole through the ground. The drill string, which is connected at one end with the boring tool and which extends from there to ground level within the hole being formed, serves to urge the boring tool forward. The apparatus also includes a transducer or other such information providing means carried by the boring tool for generating an AC signal containing certain inground information between first and second output terminals forming part of the transducer or like means. Means are also provided in accordance with the present invention for transmitting the information containing signal to an above ground location where the information can be extracted from the signal. The transmitting means includes: (1) at least a continuous section of the drill string which is sufficiently electrically conductive to carry the signal, (2) the ground surrounding the boring tool as the latter moves through the hole being formed, (3) means for electrically connecting the first output terminal of the transducer or like means directly to the continuous section of the drill string, and (4) means electrically insulated from the drill string section for causing the current to flow from the second terminal to the ground surrounding the boring tool, whereby the electrically conductive drill string section serves to carry the AC signal and the surrounding ground is used as a signal return path.

The present invention will be described in more detail hereinafter in conjunction with the drawing.

FIG. 1 diagramatically illustrates an overall boring system including an inground boring tool and an arrangement designed in accordance with the present invention for transmitting, in real time, data from the boring tool to an above ground location;

Figure 1:
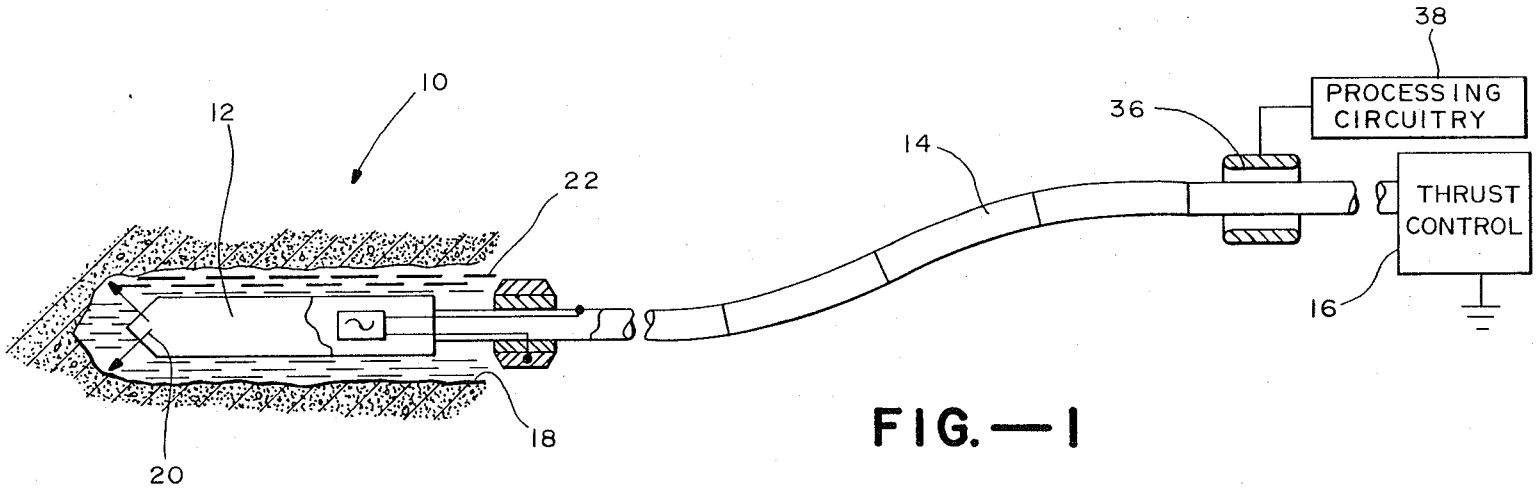

Turning now to the drawing wherein like components are designated by like reference numerals in the four figures, attention is first directed to FIG. 1 which, as stated above, diagramatically illustrates an overall boring apparatus. The apparatus which is generally indicated by the reference numeral 10 includes a boring tool 12 and drill string 14 which, for example, may be of the type described in Geller U.S. Pat. No. 4,674,579 which is incorporated herein by reference. The boring tool described in that patent is connected to one end of the drill string and both are urged forward through the soil by a suitable thrust providing device located above ground. In FIG. 1 a corresponding thrust device and associated controls for operating the entire apparatus are generally indicated at 16. It is to be understood at the outset that the present invention does not reside in any particular boring device. Any particular drill string is acceptable so long as it is compatible with the present invention as will be described below or any particular thrust providing device and controls. Reference to the Geller patent is made for exemplary purposes only. Any suitable boring device, drill string and associated components compatible with the present invention may be readily provided by those with ordinary skill in the art.

Still referring to FIG. 1, boring tool 12 is shown in operation boring through the soil, thereby forming an inground hole 18. In the particular embodiment illustrated, the boring tool utilizes fluid cutting jets 20 for cutting through the soil and therefore the hole surrounding the boring tool fills up with cutting or drilling fluid which is generally indicated at 22. This cutting or drilling fluid is utilized by the present invention, as will be seen below.

Figure 2:
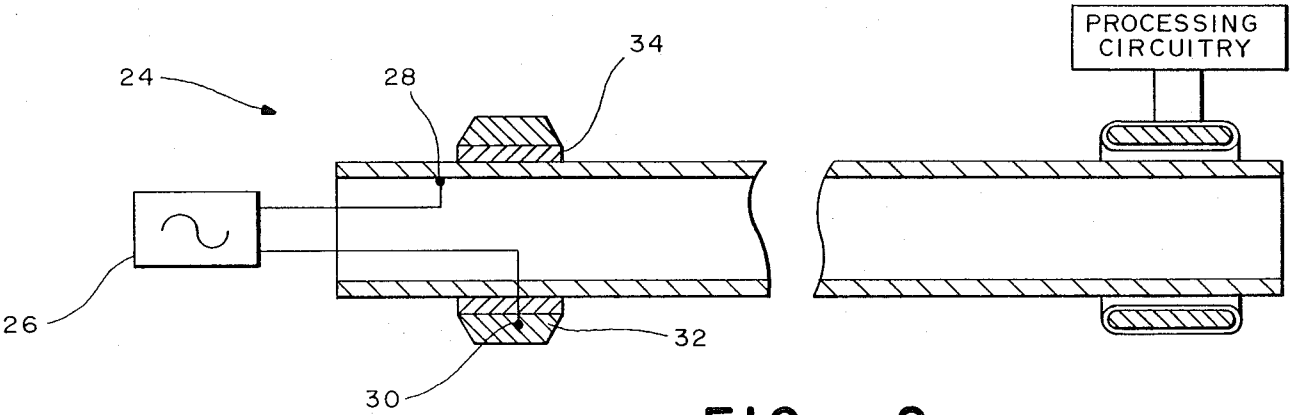
FIG. 2 is an enlarged diagramatic illustration of the data transmission arrangement forming part of the overall apparatus shown in FIG. 1.

Turning to FIG. 2 in conjunction with FIG. 1, attention is now directed to an arrangement 24 for gathering inground information at the boring tool and for transmitting the information in real time, that is, as the information is being gathered, to an above ground location where the information is retrieved and processed. Arrangement 24 includes a transducer 26 or other such information providing means carried by the boring tool for generating an AC encoded signal containing the information desired. One example of a contemplated information providing means is a rotation transducer. Other such means could include other types of position or orientation transducers or other data acquisition devices so long as the particular information is encoded and converted to an AC signal containing the particular information being generated. The transducer or other such device, like the boring tool and drill string, does not itself form part of the present invention, other than as part of the overall information gathering and transmitting arrangement. One with ordinary skill in the art in view of the teachings herein can readily provide a compatible transducer or other such means 26. For purposes of convenience, in the following description, it will be assumed that means 26 is indeed a rotation transducer with suitable electronics for producing an AC signal containing information about the rotational position of boring device 12 at any given point in time. As illustrated in FIG. 2, the AC signal is produced across two output terminals 28 and 30. In an actual working embodiment, the encoded signal is at a frequency range of approximately 1 kilohertz to 100 kilohertz with a signal amplitude of approximately a few milliamperes.

Arrangement 24, like many prior art approaches, utilizes a continuous section of drill string 14 to carry its information containing AC signal to ground level where it can be retrieved and processed. To that end, the drill string or at least a continuous section intended to carry the signal is sufficiently electrically conductive to do so. The drill string described in Geller U.S. Pat. No. 4,674,579 is one example. However, as indicated above, in the past the AC signal was typically inductively coupled to the inground end of the drill string by a suitable transformer assembly.

In accordance with the present invention, the AC signal from transducer 26 is not inductively coupled to the drill string but rather directly coupled thereto. More specifically, as illustrated best in FIG. 2, one of the two output terminals of transducer 26, for example, terminal 28, is physically connected to the drill string (e.g. the electrically conductive section). At the same time, the other output terminal, for example terminal 30, is grounded so that the drill string section serves to carry the AC signal while ground serves as a signal return path. In the particular embodiment illustrated, terminal 30 is physically connected to an electrically conductive collar 32 which extends around the electrically conductive section of drill string 14 but which is electrically insulated from the drill string by a suitable dielectric layer 34. However, the electrically conductive collar is located adjacent boring device 12 and therefore is in contact with the cutting fluid 22. Thus, the electrically conductive collar and therefore terminal 30 are grounded through the drilling fluid and the surrounding ground wall defining hole 18.

The AC signal from transducer 26 is carried up the drill string to ground level where it is inductively retrieved by a suitable transformer generally indicated at 36. In an actual working embodiment, transformer 36 is a toroidal transformer consisting of approximately 100 turns of wire. Suitable signal processing circuitry generally indicated at 38 is used to process the retrieved signal so as to retrieve the information contained within the signal. It is to be understood that transformer 36 and processing circuitry 38, like most of the other components of the overall apparatus, are readily providable by those with ordinary skill in the art and, hence, will not be described herein.

Arrangement 24 forming part of the overall apparatus 10 was described above including the insulated collar 32 exposed to drilling fluid in order to ground output terminal 30 and thereby provide a signal return path through the cutting fluid and the surrounding ground. It is to be understood that the collar itself can be placed in any suitable convenient position so long as it is electrically insulated from the drill string section carrying the signal and so long as it is indirect contact with the ground or exposed to the cutting or drilling fluid or sufficiently close to the ground to capacitively couple the signal. For example, it could be grounded to or part of the outer body of the boring head itself as long as the boring head body is electrically conductive and meets these other requirements. An entirely different means for grounding terminal 30 can also be provided, as exemplified in FIGS. 3 and 4, to be discussed immediately below.

Figure 3:
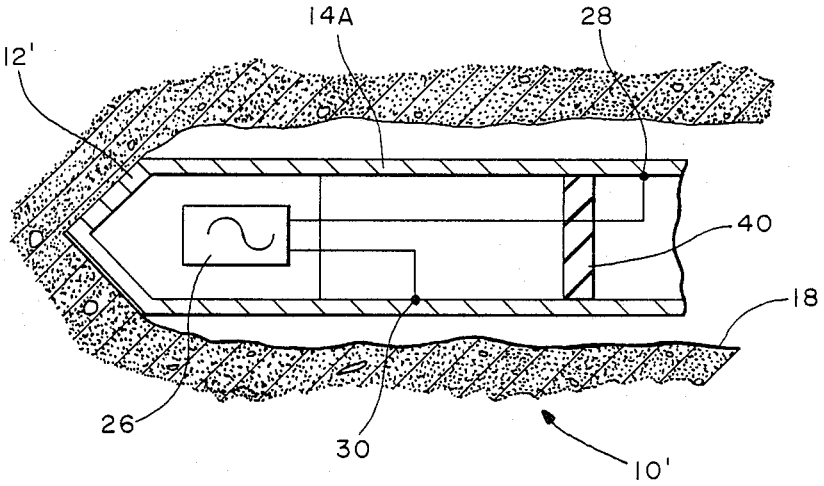
FIGS. 3 and 4 are enlarged diagramatic illustrations of two modified real time data transmission arrangements which could be utilized with the apparatus of FIG. 1.

Turning first to FIG. 3, arrangement 10' is shown. This arrangement may be identical to arrangement 10, except for the way in which terminal 30 of its transducer 26 is grounded and, possibly, the particular boring tool used. At the outset, it should be noted that arrangement 10' includes a boring tool 12', for example, an impact device, having an outer body constructed of an electrically conductive material, for example steel, electrically connected to a front section 14A of drill string 14 and electrically insulated from the rest of the drill string by a suitable dielectric separator generally indicated at 40. Terminal 28 is connected to the drill string in the manner described above. However, terminal 30 is connected directly (physically) to the outer electrically conductive housing of boring tool 12', or as shown in FIG. 3 to the electrically connected drill string section 14A, thus eliminating the utilization of collar 32 and associated insulation layer 34. Thus, as the boring tool forms hole 18 it engages drilling fluid, if any is present, thereby grounding terminal 30 in the same manner as collar 32. On the other hand, if the boring tool does not rely on fluid cutting jets in the manner described above, but rather continuously engages the end of the hole 18 as shown in FIG. 3, then the direct engagement between the boring head and the soil serves as the desired signal return path.

Figure 4:
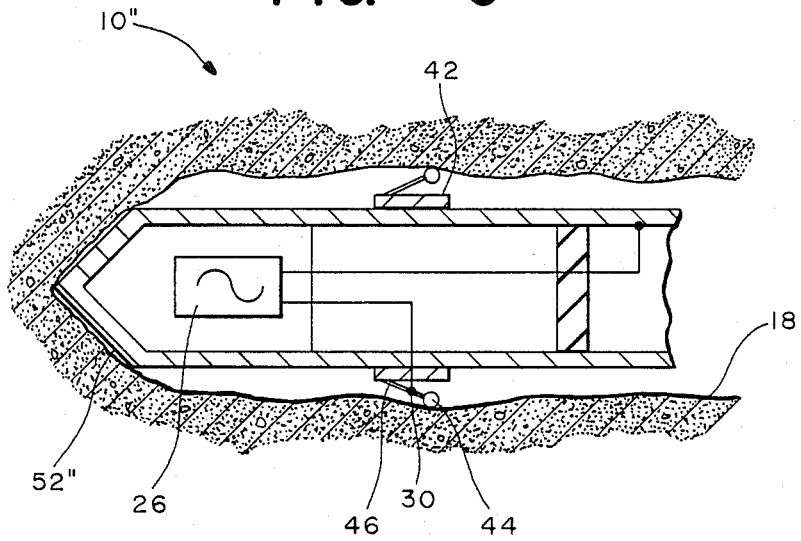

In FIG. 4, apparatus 10'' is shown and may be identical to apparatus 10 or 10' except for the way in which output terminal 30 of transducer 26 is grounded. In the case of apparatus 10'', an insulated collar 42 is disposed around the drill string and carries with it electrically conductive rollers 44 spring biased against the side wall of hole 18 so as to define ground path from terminal 30 through the collar, cooperating biasing spring arms 46 and rollers 44. One or more spring bias rollers may be utilized.

Figure 5:
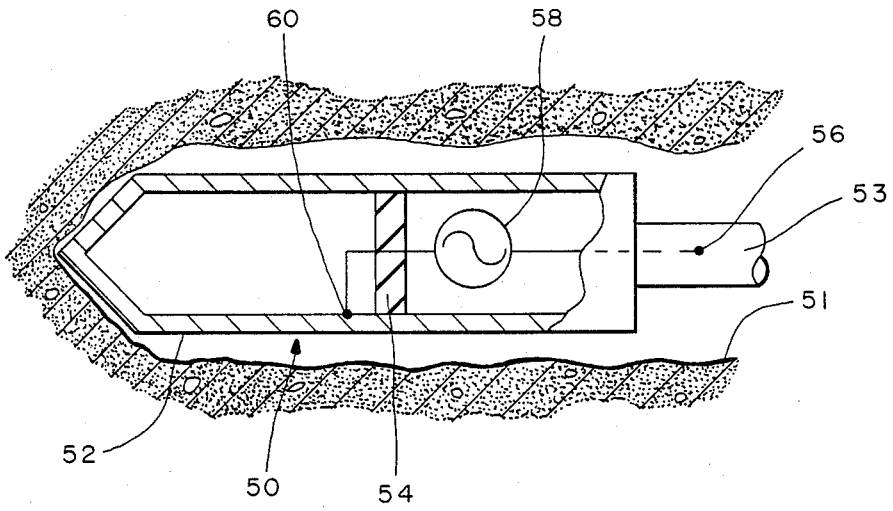
FIG. 5 shows as alternative system for use in wet or dry soils which employs a capacitive coupling capability.

FIG. 5 shows a tool head 50 which has a large forward head section 52 displaying a large surface area for direct contact with the soil 51. Forward section 52 is electrically isolated from the pipe 53 by means of insulator 54. Head section 52 can be used for boring with or without cutting fluid, e.g. bentonite or water. Its principal of operation is as follows. The thrust force on the drill pipe makes the tool head come into contact with the soil surrounding the tool head. In the event that the soil is very dry or very low in conductivity, the capacitance between the relatively large surface area of the tool head and the soil can become the dominant means of signal flow from the tool head to the surrounding soil. Once the signal is coupled into the ground the remaining signal flow is the same as previously described. Note specifically that one terminal 56 at the output of transducer 58 is connected to the drill pipe 53 while the other terminal 60 is connected to head section 52. This embodiment is to be contrasted with apparatus 10″ in FIG. 4 where there is direct contact between rollers 44 and the soil. In this latter case, the surface area of the rollers is small compared to the surface area of head section 52 of the tool 50 and displays little capacitive coupling as compared to the FIG. 4 embodiment.

Overall arrangement 24 described in conjunction with FIGS. 1 and 2 and the modifications illustrated in FIGS. 3 and 4 have been shown in combination with the boring tool and drill string exemplified in Geller U.S. Pat. No. 4,674,579. It is to be understood, however, that the arrangement could be utilized with other types of boring or drilling tools and cooperating drill strings or other electrically conductive thrusting means.

What is claimed is:

1. In a boring apparatus including a boring tool designed to bore a hole through the ground, a drill string connected at one end with said boring tool and extending from there to ground level through the hole being formed, and means for urging the boring tool and drill string forward as the hole is being made, the improvement comprising:

(a) information providing means carried by said boring tool for generating an AC signal at a frequency from about 1 KHz to about 100 KHz, containing inground information between a pair of output terminals; and (b) means for transmitting said inground information containing signal to an above-ground location where said information can be extracted from the signal, said transmitting means including electrically conductive structural means exposed to and capable of contacting the ground surrounding the boring tool as the boring tool moves through the hole being formed, at least a section of said drill string which is electrically conductive to carry said signal and which is electrically insulated from but physically connected with said structural means, means for electrically connecting one of said pairs of output terminals of said information providing means directly to said section of said drill string without inductive coupling, and means for electrically connecting the other of said output terminals directly to said structural means, whereby said drill string section serves to carry said AC signal and said structural means and surrounding ground are used as a signal return path.

2. The improvement according to claim 1 wherein said boring tool utilizes a drilling fluid during formation of said hole such that the drilling fluid surrounds the tool within the hole for contacting said structural means.

3. The improvement according to claim 1 wherein said boring tool includes an outer body section electrically insulated from said drill string section and serving as said structural means.

4. The improvement according to claim 3 wherein said drill string includes a second section electrically insulated from said first-mentioned drill string section and electrically connected with said outer body of said boring tool and wherein said second drill string section serves as said structural means.

5. The improvement according to claim 3 wherein said structural means includes an outer surface so as to capacitively couple said other output terminal to the surrounding ground in the event the ground is dry and low in conductivity.

6. The improvement according to claim 1 wherein said structural means includes means connected to said other output terminal and engaging the sidewall defining said hole.

7. The improvement according to claim 1 wherein said information providing means includes a rotation transducer.

8. A system in which a boring tool is urged through the ground by means of a drill string connected to and extending rearwardly from the boring tool in order to form a hole in the ground, an arrangement for obtaining inground information at the boring tool as the boring tool forms said hole, said arrangement comprising:

(a) transducer means carried by said boring tool for generating an AC signal having a frequency from about 1 KHz to about 100 KHz between first and second output terminals, said signal containing said information;

(b) means for transmitting said information containing signal to an above-ground location, said transmitting means including (i) at least one electrically continuous section of drill string which is electrically conductive to carry said signal, (ii) electrically conductive structural means which is electrically insulated from but physically connected with said drill string section and which is exposed to and capable of contacting the ground surrounding the boring tool as the boring tool moves through the hole being formed and, (iii) means for electrically connecting said first output terminal of said transducer directly to the electrically conductive continuous section of said drill string without inductive coupling and (iv) means for electrically connecting said second output terminal at said transducer directly to said structural means whereby said electrically conductive drive string section serves to carry said AC signal to said above ground location and said structural means and ground serves as a signal with return path; and (c) means located at said above ground location for acting on said AC signal and extracting said information from the AC signal.

9. An arrangement according to claim 8 wherein said means located above ground includes conductive coupling means located around this segment of said electrically conductive drill string section at said above ground location.

10. An arrangement according to claim 8 wherein said boring tool utilizes a drilling fluid curing formation of said hole such that the drilling fluid surrounds the tool within the hole.

11. An arrangement according to claim 8 wherein said boring tool includes an outer body electrically insulated from said drill string section and serving as said structural means.

12. An arrangement according to claim 11 wherein said drill string includes a second section electrically insulated from said first drill string section and electrically connected with said outer body of said boring tool and wherein said second drill string section serves as said structural means.

* * * * *